United States Patent [19]

Victor et al.

[11] 4,057,160

[45] Nov. 8, 1977

[54] SELF-RETAINING BOTTLE STOPPER

[75] Inventors: George Victor; Robert G. Fisher; Kaspar Bischof, all of Modesto, Calif.

[73] Assignee: E. & J. Gallo Winery, Modesto, Calif.

[21] Appl. No.: 654,326

[22] Filed: Feb. 2, 1976

[51] Int. Cl.[2] ..... B65D 41/06; B65D 41/28

[52] U.S. Cl. ..... 215/318; 215/320; 215/339

[58] Field of Search ..... 215/318, 320, 329, 330, 215/339, 344, 356, 357

[56] References Cited

U.S. PATENT DOCUMENTS

| | | | |
|---|---|---|---|
| 1,308,745 | 7/1919 | Hammer | 215/339 |
| 2,171,015 | 8/1939 | Webb | 215/318 |
| 3,057,503 | 10/1962 | Salzmann | 215/320 X |
| 3,069,040 | 12/1962 | Corsette | 215/318 |
| 3,142,402 | 7/1964 | Fox | 215/320 X |
| 3,223,269 | 12/1965 | Williams | 215/318 |
| 3,653,529 | 4/1972 | Segmuller | 215/320 X |
| 3,716,163 | 2/1973 | Marcel | 215/320 |
| 3,910,444 | 10/1975 | Foster | 215/318 X |
| 3,955,696 | 5/1976 | Finke | 215/318 X |

FOREIGN PATENT DOCUMENTS

| | | | |
|---|---|---|---|
| 1,369,847 | 7/1964 | France | 215/320 |
| 1,388,710 | 1/1965 | France | 215/320 |

*Primary Examiner*—Stephen Marcus
*Attorney, Agent, or Firm*—Townsend and Townsend

[57] ABSTRACT

A self-retaining stopper for bottle containing pressurized contents such as champagne is disclosed. The stopper is especially adapted to cooperate with a bottle finish having a plurality of raised helical ribs of substantially uniform width and uniform maximum height spaced regularly around the circumference of the finish. The stopper comprises a shank for sealable insertion into the neck of such a bottle and a cup-shaped crown defining a resilient skirt overlying the finish. The skirt includes a plurality of inwardly projecting nodular protrusions for engaging the lower side of the helical ribs upon the inwardly directed urging of the resilient skirt. The inner wall of the skirt further includes a plurality of webs disposed to encounter the upper rim of the finish. The nodular protrusions and the webs are spaced apart a predetermined distance to secure the stopper in an axially locked position against the high pressures encountered within the bottle without the need for safety wiring or the like. The stopper permits axial insertion into and twistable removal from the neck of the container.

4 Claims, 6 Drawing Figures

SELF-RETAINING BOTTLE STOPPER

BACKGROUND OF THE INVENTION

1. Field of Invention

This invention relates to stoppers for bottles, flasks or the like containers having pressurized contents. In particular, it relates to crowned stoppers for champagne bottles which may be secured at the time of bottling without a safety wiring or the like.

2. Description of the Prior Art

The shape and design of wine and champagne bottles are dictated somewhat by tradition and etiquette as well as by considerations in the bottling process. Limitations may therefore be imposed on the type of stopper employed. For example, the twist-on type cap presently in use for bottled beverages in the United States or the wire and porcelain safety-latch type stopper used for bottled beverages in Europe would be unacceptable as aesthetically displeasing at the formal dinner table. Other types of stoppers, for example, stoppers which must be twistably applied, would complicate the bottling process and therefore would increase mass production cost.

A stopper for a champagne bottle should be easily insertable and removable, yet capable of withstanding substantial pressure over long storage periods without deterioration or effect on the contents. It should also be capable of reliably resealing the bottle contents. Mere twist-on, twist-off caps have been found unsuitable for this purpose.

Crowned stoppers are well known closures for bottles containing sparkling beverages such as champagne or like wines. U.S. Pat. No. 3,716,163 issued to Henri Marcel of France is but one example of a crowned stopper. During the bottling process, the traditional crowned stopper is typically driven into, rather than twisted or molded onto, the neck of a filled bottle.

A safety wiring typically binds the stopper to the bottle finish to prevent the accidental ejection of the stopper between the time of bottling and the time of initial opening. A safety wiring, although inconvenient to remove, does assure that the stopper remains in place. Nevertheless, the installation of a safety wiring is a step in the bottling process which is desirable to eliminate.

Efforts have been made to eliminate the need for a safety wiring with a crowned stopper. For example, one approach is a two-piece crowned stopper called TOP, which is manufactured by Pfefferkorn of Germany. The stopper comprises a crown and a separable shank portion. The shank portion has a series of skirts which engage and lock against the outer surface of an unmodified bottle finish only when the crown is pressed down and locked against the latching skirts. The latches are released by twisting and pulling on the crown, which in turn permits the user to withdraw the shank portion from the neck of the bottle. In order to provide this capability, the stopper must be manufactured in two pieces and subsequently assembled.

Alternatively, the compression and thus the security of the inner friction fit of the shank of the traditional crowned stopper may be increased. However, an increase in the compression increases the force required to withdraw the stopper, which is undesirable from the user's viewpoint.

It is therefore a primary object of the present invention to provide a simple, one-piece crowned stopper suitable for a bottle containing champagne or a like beverage under pressure which may be axially inserted or driven into a bottle neck, which need not be secured by a safety wiring, which may be easily removed by hand.

SUMMARY OF THE INVENTION

In accordance with the invention, a self-retaining stopper is provided for containing pressurized contents such as champagne in a bottle, flask or like container. The stopper is adapted to cooperate with a bottle finish having a plurality of raised helical ribs of substantially uniform width and uniform height spaced regularly around the circumference of the finish. The stopper comprises a shank for sealable insertion in the bottle neck and a cup-shaped crown defining a resilient skirt overlying the finish. The skirt includes a plurality of inwardly projecting lugs or nodular protrusions for engaging the lower side of the helical ribs upon the inwardly directed urging of the resilient skirt. The skirt further includes a plurality of webs disposed to encounter the upper rim of the finish.

The lugs and the webs are spaced apart a predetermined distance to secure the stopper in an axially locked position against the high pressures encountered within the bottle. Safety wiring or the like is unnecessary to retain the stopper. A stopper according to the invention permits axial insertion into and twistable removal from the neck of the bottle. Both axial insertion and twistable removal can be effected by hand with relative ease.

BRIEF DESCRIPTION OF THE DRAWINGS

The invention will best be understood by reerence to the accompanying detailed description in conjunction with the drawings, in which.

DETAILED DESCRIPTION OF SPECIFIC EMBODIMENTS

Figure 1:
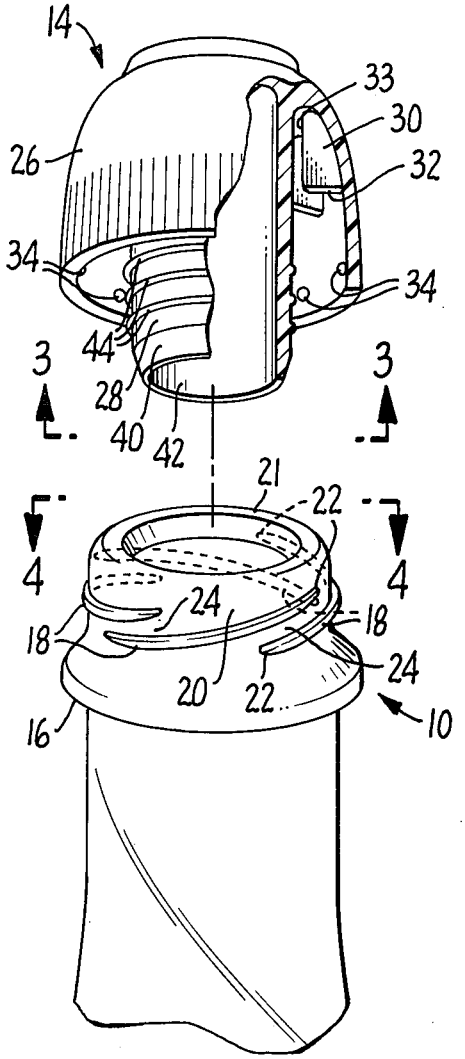
FIG. 1 is an exploded perspective view in partial cut-away illustrating a first embodiment of a self-retaining stopper and a glass finish.

FIG. 1 shows a perspective view of a preferred embodiment of a finish 10 of a glass bottle 12 and a preferred embodiment of a self-retaining stopper 14 for use with the finish 10. The bottle 12 is of the type adapted for containing sparkling beverages such as champagne and the like under pressure.

The preferred glass finish includes a flared bead 16 extending therefrom in an conventional and traditional manner and a plurality of regularly spaced helical ribs 18 of substantially uniform width and uniform maximum height raised with respect to a generally straight cylindrical outer surface 20 of the finish 10. The cylindrical surface 20 terminates in a rim 21. The ribs 18 terminate in tapered, rounded ends 22.

In the preferred embodiment of the finish 10, four ribs 18 are provided around the finish circumference. Each rib 18 may be raised about 0.06 inch from the surface 20 and arranged at a helical angle of about 10° with respect to the axis of the finish 10. Preferrably, the four ribs 18 extend at least approximately 120° around the finish circumference, thereby to provide a rib overlap of approximately 30° or about ¼ of the total rib arc length defining thread channels 24 at each end of the individual ribs 18.

The self-retaining stopper 14 includes a skirt 26 having a shank 28 extending co-axially from within the skirt 26. Near the junction of the shank 28 and the skirt 26, a plurality of rigid webs 30 project inwardly from the skirt 26. Each web 30 includes a radial edge 32. The radial edges 32 are all positioned in a common plane perpendicular to the axis of the shank 28. As such, each edge 32 is positioned so that each may simultaneously encounter the rim 21 when the stopper 14 is axially inserted as intended into the neck of the bottle 12. Each web 30 preferably includes an axial edge 33 opposing the portion of the shank 28. The edges 33, however, are not essential to the function of the invention, but are a design feature for convenience of manufacture.

The shank 28 includes a slightly tapered end 40 adjacent an opening 42. Several annular ribs 44 extend outwardly from the shank 28. The ribs 44 are adapted to sealably confront the inner circumference of the bottle neck. The shank is preferably hollow so that the seal between the ribs 44 and the inner circumference of the bottle neck may be better established by the outwardly directed pressure from within the shank 28.

Along the inside edge of the skirt 26, a plurality of regularly spaced nodular protrusions or lugs 34 is provided. These lugs 34 may be aligned axially with the webs 30, although such alignment is not critical to the functioning of the invention. Preferably, six regularly spaced lugs 34 are provided, each of which may protrude about 0.06 inch from the inside wall of the skirt 26.

Figure 2:
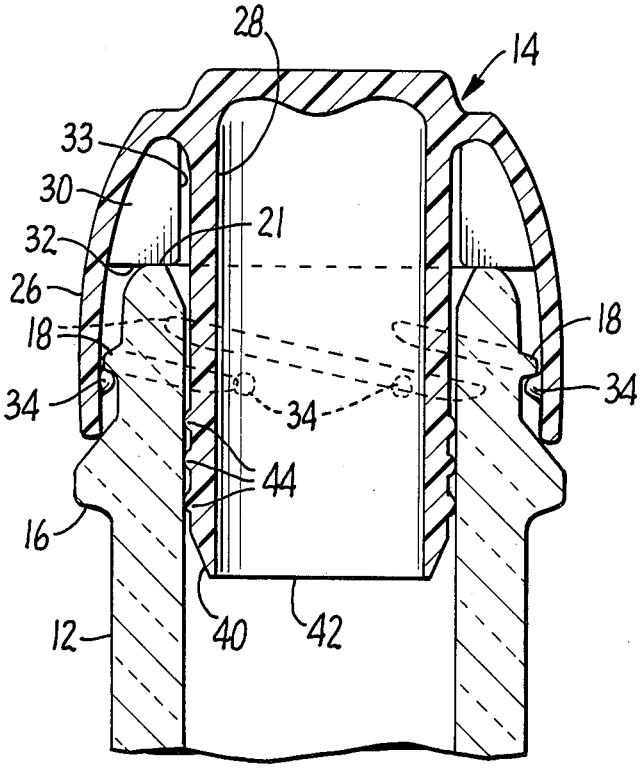
FIG. 2 is a vertical sectional view of the stopper of FIG. 1 applied in its fully inserted locked position to the finish.

Referring to FIG. 2, the stopper 14 is shown in a fully inserted position with the radial edges 32 of the rigid webs 30 resting against the rim 21 and with the lugs 34 hooked under the lower side of the ribs 18. The protrusions 34 are spaced from the web radial edges 32 a distance approximately equal to the distance on the finish 10 from the rim 21 to the furthest point of the extreme or lower side of the ribs 18. A secure lock of the stopper 14 to the finish 10 is provided when selected lugs 34 engage the lowest portions of the lower side of selected ribs 18.

Figure 3:
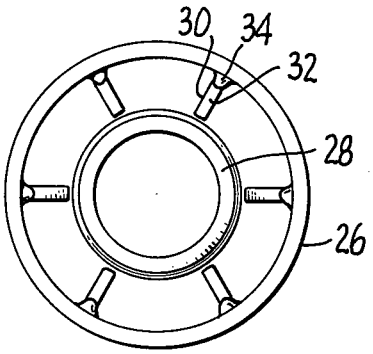
FIG. 3 is a bottom-plan view of the stopper of FIG. 1.
Figure 4:
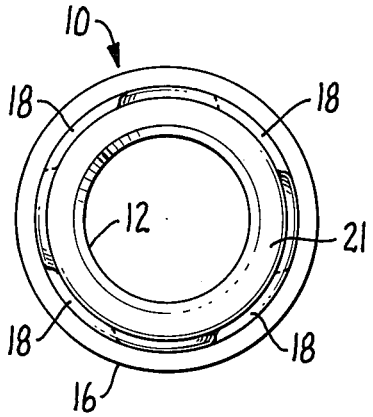
FIG. 4 is a top-plan view of the glass finish of FIG. 1.

FIG. 3 is a bottom-plan view of the stopper, showing the alignment of the webs 30 and the preferred number of six protrusions 34 of the preferred embodiment of FIG. 1. FIG. 4 is a top-plan view of the finish 10 illustrating the preferred four ribs 18 with the approximate 30° overlap at each end thereof.

According to the invention, when the stopper 14 is fully inserted into the bottle 12 of the preferred embodiment, all of the lugs 34 locate below the lower edge of at least one of the ribs 18 and at least two of the lugs 34 locate adjacent the lower edge of at least two corresponding ribs 18 in the region of the 30° rib overlap. At a relative position of the finish 10 and the stopper 14 where the lugs 34 are aligned with the lower rib ends 22, and where the stopper 14 is in the fully inserted position, the spacing between the web edges 32 and the lugs 34 is such that the web edges 32 firmly engage the rim 21 and two lugs 34 may fully engage the ribs 18, thereby maintaining the stopper 14 in a securely locked position. The security of this locked position is assisted by the snug pressure fit of the shank ribs 44 against the inner circumference of the bottle neck and by the inwardly directed pressure of the skirt 26 on the lugs 34. Upon twisting of the stopper 14 in the appropriate direction, the lugs 34 engage the top edge of the ribs 18, urging removal of the stopper 14.

The flexure of the skirt 26 is of relative importance. The material forming the stopper 14 must be pliable yet resilient. In particular, in the preferred embodiment, the skirt 26 of the stopper 14 must be able to expand outwardly at the location of each lug 34 approximately 0.06 inch and to recover substantially to the unstressed position with sufficient inwardly directed pressure to lockingly engage the ribs 18.

Several synthetic materials are suitable for use in molded stoppers according to the specific embodiments herein disclosed. For example, polypropylene has the suitable resilient qualities so that the skirt 26 of the stopper 14 provides a secure lock. However, a stopper 14 of nylon material having skirt walls of approximately 0.06 inch has been found most satisfactory. A nylon stopper has been proven to be secure up to temperatures of 135° F and to internal pressures of 150 psi, which parameters are well above those normally encountered by any bottle containing sparkling beverages. Nylon is of particular advantage because many otherwise suitable plastics, for example, polypropylene, distort at such elevated pressures and temperatures. Other materials may be economically utilized where the criteria of resistance to temperature and pressure, resiliency, strength and resistance to deformation are met.

The angle of the upper edge and of the lower edge of the ribs 18 may be selected to achieve relative ease of axial insertion of the stopper 14 and firm interlock between the ribs 18 and the lugs 34. For example, in the preferred embodiment of the finish 10, the angle of the lower side of the ribs 18 is selected to provide a taper at approximately 4° above a plane perpendicular to the axis of the finish 18. The taper on the opposite or upper side of each rib 18, in contrast, is in the range of approximately 25° below a perpendicular plane.

Figure 5:
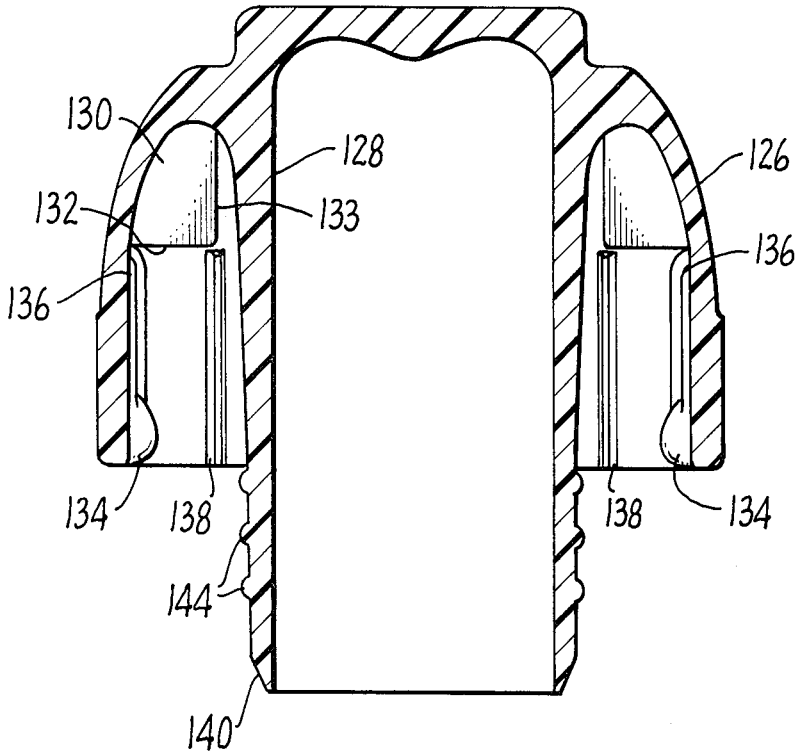
FIG. 5 is a vertical sectional view of a second embodiment of a stopper according to the invention; and, FIG. 6 is a bottom-plan view of the stopper of FIG. 5.

FIG. 5 shows a further preferred embodiment of a stopper 114 according to the invention. The stopper 114 includes a skirt 126 and a shank 128 extending co-axially from within the skirt 126. Webs 130 project inwardly from the inner wall of the skirt 126. Radial edges 132 are provided for confronting the rim 21 of a bottle neck upon insertion of the stopper 114.

The shank 128 is shown to include a slightly tapered end 140 adjacent an opening 142. Several annular ribs 144 project outwardly from the shank 128. The ribs 144 are adapted to sealingly confront the inner circumference of the neck 12. The shank 128 is preferably hollow so that the seal between the ribs 144 an the inner circumference of the container 12 may be more securely sealed by outwardly directed pressure from within the shank 128.

Figure 6:
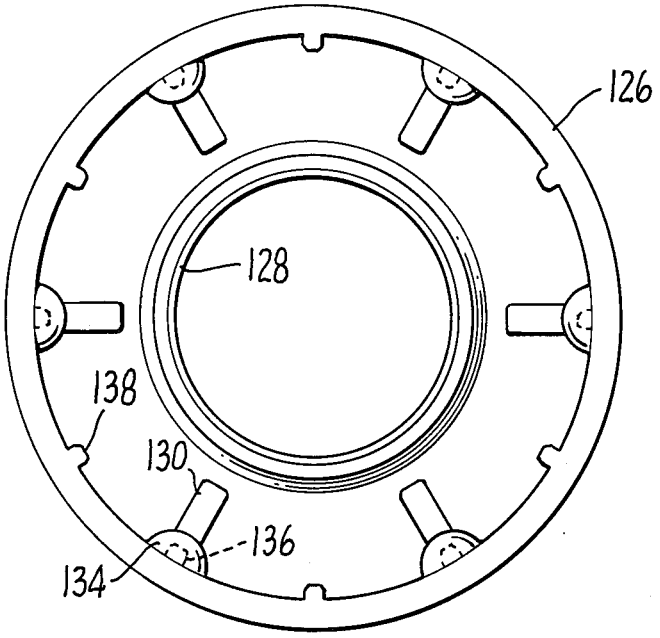

Along the inner edge of the skirt 126 is a plurality of nodular protrusions or lugs 134, each having a width approximately equal to its height. Referring to FIG. 6 in conjunction with FIG. 5, there is shown associated with each lug 134 an inwardly directed vertical thin, tapered fin 136, approximately the same height as the protrusion 134 and integral therewith. Underlying each fin 136 may be an axial rib 134 approximately the width of the nodular protrusion 134. Alternatively, each fin 136 may protrude from the wall of the skirt 126. Each fin 136 is of a length at least as great as the length of the thread path 24 and adjacent ribs 18. The lugs 134 and fins 136 may be aligned with the webs 130. Preferably, the lugs 134 are spaced from the edges 132 a distance approximately equal to the distance between the rim 21 and the furthest point of the lower wide of the ribs 18. A series of thin fins 138 may be provided which project inwardly from the skirt 126 between the fins 136.

In FIG. 5, a portion of the skirt 126 is illustrated showing one of the lugs 134 with an integral fin 136. The solid line represents the contour of a fin 136 prior to the insertion of the stopper 114 into the finish 10. Upon insertion of the stopper 114 into the finish 10, the fins 136 and 138 are partially crushed by the ribs 18, thereby partially defining a thread path for the ribs 18, and providing further means frictionally engaging the ribs 18 for resisting stopper ejection which may be caused by excessive pressure. A similar deformation may take place in the series of thin fins 138.

During the molding and formation process of the stopper, the fins 136 provide a further function. The material from which the stopper may be formed is generally relatively soft and maleable when at holding temperatures, thus upon removal of the stopper 114 from its hot mold, the lugs 134 are subject to undesirable and often unacceptable deformation. The fins 136 attached to the lugs 134 substantially reduce the deforming effect of the hot mold during the withdrawal process by retaining the lugs 134 in the desired position at least until cooling. This feature permits a more rapid molding cycle, since the mold need not be substantially cooled before removal of the formed piece.

Stoppers according to the specific embodiments herein disclosed have been found to be advantageous for several reasons. For example, in the embodiments utilizing six lugs in conjunction with four 120° arc length ribs, at least two lugs 34 lockingly engage the ribs 18 when the stopper is in the fully inserted position. If fewer protrusions or lugs 34 were to engage the ribs 18, the stopper 14 might be accidentally ejected. The remaining lugs 34 provide convenient guides for engaging the thread paths 24 urging the stopper to open when it is twisted. However, if the stopper 14 has more than about six regularly spaced protrusions or lugs 34 it may be inconveniently difficult to unscrew and remove the stopper 14 from the finish 10. Thus, an optimum number of six lugs 34 permits the stopper 14 to be twistably removed from the finish 10 by hand and still provide sufficient resistance to pressure to securely lock the stopper to the finish 10. Furthermore, a stopper of the present design may be axially inserted, that is, driven either by machine or by hand, into the neck of the bottle.

In the particular embodiments herein disclosed and described, the inner diameter of the skirt 26 is approximately the same dimension as the maximum diameter of the finish 10 at the maximum height of the ribs 18. In particular embodiments herein disclosed where the stopper 14 is fully inserted into the finish 10, the extreme or lower side of the ribs 18 and the confronting portion of the lugs 34 may overlappingly engage between about 0.019 inch and about 0.024 inch, depending upon the axial position of the protrusions or lugs 34 with respect to the ribs 18.

The stopper, according to the present invention, may be conveniently utilized in conjunction with automatic bottling machinery providing for axial insertion of the stopper into the neck of a beverage bottle. Similarly, the stopper, according to the invention, may be twistably removed by hand with relative ease and thereafter inserted by hand with relative ease into the neck of the bottle from which is has been removed. As an aid to the twistable removal of a stopper according to the invention, the outer surface, or skirt of the stopper, may be provided with grooves allowing a better hand-grip.

As various changes may be made in the form, construction and arrangement of the parts without departing from the essential features of this invention, and without sacrificing any of its advantages, it is to be understood that the invention herein disclosed should not be limited except as indicated by the appended claims.

We claim:

1. In combination, a self-retaining bottle stopper and a finish of a bottle adapted to contain pressurized contents:

a. said finish comprising a tubular neck having an annular top margin about the opening thereof, an inner circumference, an outer circumference and a plurality of straight, helical ribs of uniform width and height, each of said helical ribs partially circumscribing said outer circumference and defining partially overlapping thread zones;

b. said stopper comprising:

i. a cup-shaped crown defining a skirt for capping said neck;

ii. a hollow cylindrical shank depending co-axially from within said crown, including means for sealably engaging the inner circumference of said neck;

iii. a plurality of resilient, deformable webs all circumferentially arrayed within said crown, such that each presents an edge in a plane perpendicular to the axis of said shank for encountering the top margin of said necks;

iv. a plurality of lugs projecting radially inwardly from said skirt and annularly aligned in a plane perpendicular to said shank and adapted to lockingly confront said ribs on the lower side from said top margin;

v. said web edges and said lugs being spaced relative to said top margin and said lower rib side furthest from said top margin such that at least two of said lugs lockingly encounter said lower rib side of selected ribs upon full axial insertion of said stopper into said finish; and vi. an inwardly extending relatively thin fin integrally associated with each of said lugs and axially aligned with respect to the axis of said shank, each said fin being adapted to collapsibly deform to the contour of a corresponding rib, thereby to partially define a rib thread path.

2. A combination finish and stopper according to claim 1, wherein said lower side of said helical ribs define an angle approximately 4° above a plane perpendicular to the axis of said neck.

3. A combination finish and stopper according to claim 2 wherein said stopper includes six evenly radially spaced lugs and said finish includes four helical ribs of approximately 120° arc length at a helical angle of approximately 10°.

4. A self-retaining bottle stopper for axial insertion into and twistable removal from the tubular neck of a bottle adapted to contain pressurized contents, wherein said neck includes a finish with a plurality of raised, helical ribs about the outer circumference, said bottle stopper comprising :

a. a cup-shaped crown defining a deformable resilient skirt for capping said neck;

b. a cylindrical shank depending co-axially from within said crown, including means for sealably engaging the inner circumference of said neck ;

c. a plurality of resilient deformable webs radially arrayed about the circumference of said crown, each presenting an edge in a common plane perpendicular to the axis of said shank for encountering said rim of said neck;

d. a plurality of lugs projecting radially inwardly from said skirt annularly aligned in a common plane perpendicular to said shank, said lugs adapted to lockingly engage said ribs on the lower side of said neck rim;

e. said web edges and said lugs being spaced relative to said neck rim and said lower side such that at least two of said lugs lockingly confront the lower rib side of at least two of said ribs upon full axial insertion of said stopper;

f. said lugs being adapted to engage the upper side of said ribs upon twistable withdrawal, thereby urging the removal of said stopper from said bottle neck;

g. said lugs also confronting said lower rib side with sufficient pressure to lockingly bias said lugs tightly against said ribs upon full axial insertion of said stopper, thereby to prevent ejection of said stopper resulting from contemplated pressure within said bottle;

h. said skirt being approximately equal in diameter to the maximum diameter of said finish; and i. an inwardly extending relatively thin fin integrally associated with each of said lugs and axially aligned with respect to the axis of said shank, each said fin being adapted to collapsibly deform to the counter of a corresponding rib, thereby to partially define a rib thread path.

* * * * *